United States Patent [19]

Hattori

[11] 4,199,939

[45] Apr. 29, 1980

[54] SECONDARY AIR SUPPLY SYSTEM FOR THE EXHAUST SYSTEM OF AN INTERNAL COMBUSTION ENGINE

[75] Inventor: Kyo Hattori, Susono, Japan

[73] Assignee: Toyota Jidosha Kogyo Kabushiki Kaisha, Japan

[21] Appl. No.: 893,393

[22] Filed: Apr. 4, 1978

[30] Foreign Application Priority Data

Dec. 29, 1977 [JP] Japan ..... 52/159305

[51] Int. Cl.[2] ..... F01N 3/10

[52] U.S. Cl. ..... 60/276; 60/290

[58] Field of Search ..... 60/289, 290, 276

[56] References Cited

U.S. PATENT DOCUMENTS

| | | | |
|---|---|---|---|
| 3,931,710 | 1/1976 | Hartel | 60/290 |
| 3,962,867 | 6/1976 | Ikeura | 60/290 |
| 4,087,964 | 5/1978 | Miyagi | 60/290 |
| 4,100,735 | 7/1978 | Miyagi | 60/290 |

*Primary Examiner*—Douglas Hart

*Attorney, Agent, or Firm*—Stevens, Davis, Miller & Mosher

[57] ABSTRACT

A secondary air supply system for the exhaust system of an internal combustion engine having a catalytic converter with a three-way catalyst, having an air control valve which selectively supplies a part of compressed air to the exhaust system while relieving the rest of the air to the atmosphere, wherein the air control valve has a valve element balanced by oppositely acting springs to a neutral position where it supplies a predetermined amount of secondary air necessary to provide stoichiometric exhaust gases at a standard flow of exhaust gases and is shifted to opposite sides of the neutral position in accordance with oscillation of feedback control of the air/fuel ratio of exhaust gases, the neutral position being shifted in accordance with changes of the flow of exhaust gases from the standard flow by diaphragm means against the balancing spring force in order to make the neutral position follow the flow of exhaust gases.

10 Claims, 5 Drawing Figures

SECONDARY AIR SUPPLY SYSTEM FOR THE EXHAUST SYSTEM OF AN INTERNAL COMBUSTION ENGINE

BACKGROUND OF THE INVENTION

The present invention relates to a secondary air supply system for the exhaust system of an internal combustion engine, and, more particularly, to an air control valve incorporated in the secondary air supply system.

In an exhaust gas purifying system which incorporates a three-way catalyst for simultaneously removing HC, CO, and NOx contained in the exhaust gases of an internal combustion engine, the air/fuel ratio of the exhaust gases must be controlled to be within a relatively narrow range of the stoichiometric air/fuel ratio in order to obtain effective performance of the three-way catalyst. Therefore, in the exhaust gas purifying system incorporating a three-way catalyst, the air/fuel ratio of engine intake mixture is set on the smaller or rich side of the stoichiometric air/fuel ratio, and the exhaust gases generated from such a mixture are supplied with secondary air while the air/fuel ratio is monitored by an oxygen detector so that the air/fuel ratio of the exhaust gases introduced into the three-way catalyst is maintained within a relatively narrow range (the window range) around the stoichiometric air/fuel ratio which is required to obtain effective performance of the three-way catalyst.

A secondary air supply system which supplies secondary air to the exhaust system of an engine for the aforementioned purpose generally comprises a source of compressed air such as an air pump driven by the engine, an air control valve which supplies a part of the air delivered from said source to the exhaust system of the engine while relieving the rest of the air, an oxygen detector for detecting residual oxygen contained in the exhaust gases flowing through the exhaust system, a source of actuating fluid pressure (for which the intake manifold generally serves to supply intake manifold vacuum as the actuating fluid pressure), a change-over valve for said actuating fluid pressure, and a controller which changes over said change-over valve in accordance with the output of said oxygen detector, said air control valve supplying the air delivered from said source of compressed air to the exhaust system as secondary air when said oxygen detector detects no residual oxygen while it stops supplying secondary air to the exhaust system while relieving the air supplied from said source of compressed air to the atmosphere, or, generally, into the air cleaner of the engine, when the oxygen detector detects residual oxygen. The air control valve incorporated in the conventional secondary air supply system generally comprises an inlet port for receiving air from a source of compressed air such as an air pump driven by the engine, an outlet port for supplying a part of the air received to the exhaust system, a relief port for relieving the rest of the air received, a first passage which connects said inlet port and said outlet port, a second passage which connects said inlet port and said relief port, a valve element which reciprocally controls the openings of said first and second passages, first and second diaphragm chambers selectively supplied with either intake manifold vacuum or atmospheric pressure by way of said change-over valve, and at least one diaphragm which defines said individual diaphragm chambers and is connected with said valve element, wherein said diaphragm is adapted so as to shift said valve element in the direction to open said first passage and to close said second passage when said first diaphragm chamber is supplied with intake manifold vaccum while said second diaphragm chamber is opened to the atmosphere, and so as to shift said valve element in the direction to open said second passage and to close said first passage when said second diaphragm chamber is supplied with intake manifold vacuum while said first diaphragm chamber is opened to the atmosphere.

The secondary air supply system for the exhaust system of an internal combustion engine which incorporates an air control valve of the aforementioned structure together with an oxygen detector, a vacuum change-over valve, and a controller which changes over said vacuum change-over valve in accordance with the output of said oxygen detector is a feedback control system which supplies additional air as the secondary air to the basic exhaust gases having an air/fuel ratio which is somewhat lower than the lower limit of the window range, whereby the air/fuel ratio of exhaust gases is controlled in a manner such that it changes in the shape of triangular pulse waves going up and down on either side of the center of the window range. In this case, if the flow resistance of the passages for introducing intake manifold vacuum or atmospheric pressure to said first and second diaphragm chambers is reduced, i.e., the throttling ratio of a throttling element normally provided in such a passage is reduced, in order to increase the response speed of the feedback control system, the amplitude of the triangular pulse waves becomes greater, and the phase region in which the air/fuel ratio of exhaust gases overshoots or undershoots the window region increases, thereby reducing the effectiveness of the three-way catalyst. If, on the other hand, in view of the abovementioned problem, the throttling ratio of the fluid passages for said first and second diaphragm chambers is increased in order to reduce the amplitude of the triangular pulse-like changes of the air/fuel ratio of exhaust gases so that it is contained in the window range, the response speed of the feedback control system lowers, and the control of the secondary air supply cannot follow swift changes of intake air flow or fuel-air mixture of the engine, also resulting in poor effectiveness of the three-way catalyst exhaust purifying system as a whole.

Particularly, in a secondary air supply system for the exhaust system of an internal combustion engine of the aforementioned conventional structure, there is a problem that when the intake air flow or air/fuel ratio of the engine abruptly changes, the controlled air/fuel ratio of exhaust gases greatly changes because the operational inertia and delay in response of the system are relatively large.

SUMMARY OF THE INVENTION

It is therefore the object of the present invention to deal with the aforementioned problems with regard to the conventional secondary air supply system for the exhaust system of an internal combustion engine, particularly the problems with regard to the conventional air control valve, and to provide an improved secondary air supply system for the exhaust system of an internal combustion engine, which is able to maintain the air/fuel ratio of exhaust gases within a narrow window range centered at the stoichiometric air/fuel ratio with correct and quick response.

Another object of the present invention is to provide an improved secondary air supply system for the exhaust system of an internal combustion engine, which is able to follow the changes of intake air flow or air/fuel ratio of the engine continuously and efficiently and is able to maintain the air/fuel ratio of exhaust gases within the window range even when the intake air flow or the air/fuel ratio of the engine is abruptly changed.

BRIEF DESCRIPTION OF THE DRAWINGS

The present invention will become more fully understood from the detailed description given herein below and the accompanying drawings, which are given by way of illustration only, and thus are not limitative of the present invention, and wherein.

DESCRIPTION OF THE PREFERRED EMBODIMENT

Figure 1:
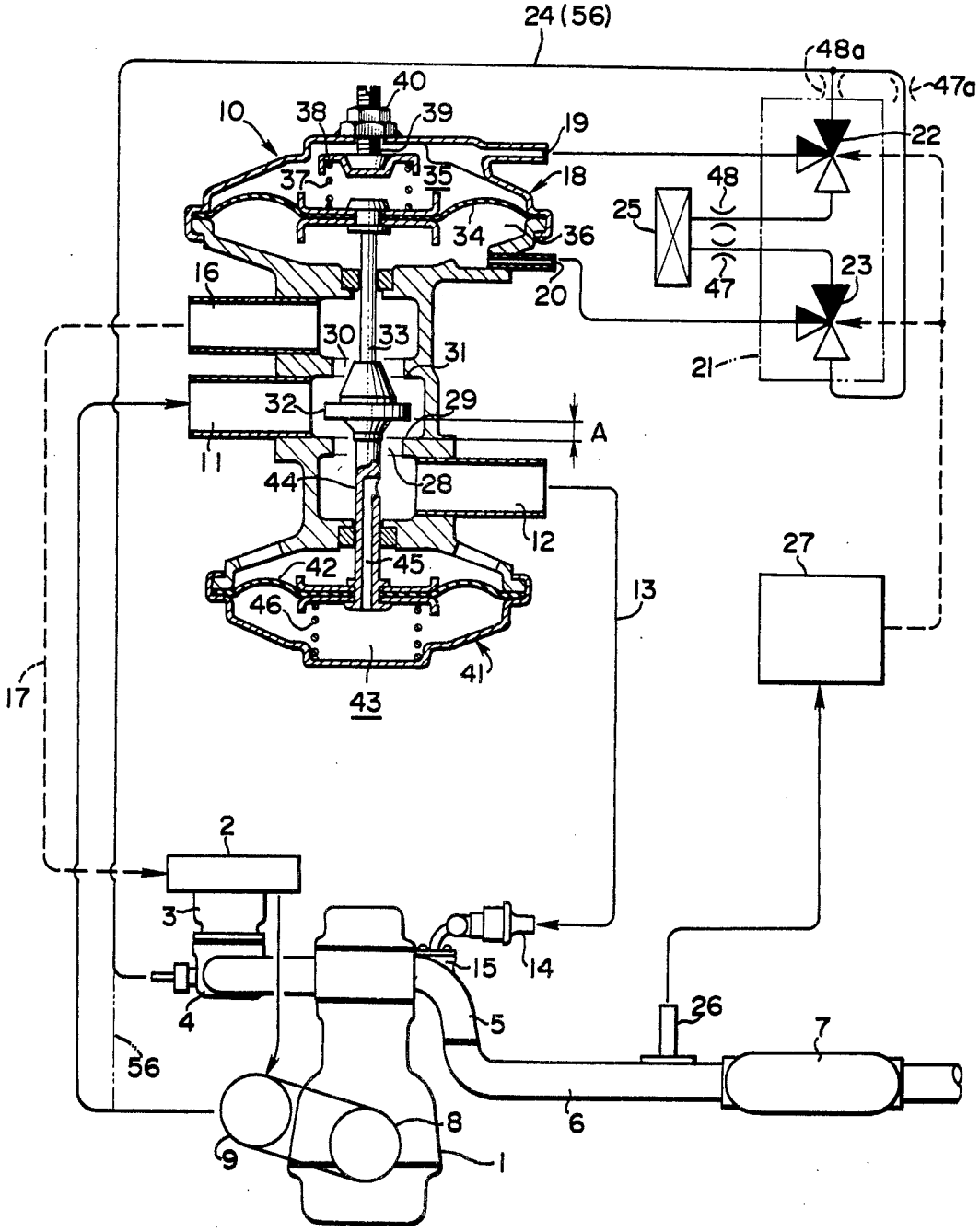
FIG. 1 is a diagrammatical view showing an embodiment of the secondary air supply system for the exhaust system of an internal combustion engine constructed in accordance with the present invention.

Referring to FIG. 1, 1 designates an internal combustion engine which takes in air through an air cleaner 2, a carburetor 3 and an intake manifold 4 and discharges exhaust gases through an exhaust manifold 5 and an exhaust pipe 6 which incorporates at a middle portion thereof a catalytic converter 7 containing a three-way catalyst, whereby the engine generates a rotary power in a crankshaft 8. 9 designates an air pump which is driven by the crankshaft 8 and serves as a source of compressed air to be supplied as secondary air. The air delivered from the air pump 9 is conducted to an inlet port 11 of an air control valve 10, wherein a part of the air is conducted to an outlet port 12 and is further conducted through a passage 13 and a secondary air manifold 14 to be supplied to the exhaust system of the engine through a secondary air supply port 15, whereas the rest of the air received by the air control valve 10 is conducted to a relief port 16 and is further conducted through a passage 17 to be relieved to the atmosphere, or particularly in the shown embodiment to be relieved into the air cleaner 2. The air control valve 10 has a diaphragm means 18 having two actuating fluid supply ports 19 and 20 which are adapted to be selectively supplied with either intake manifold vacuum taken out from the intake manifold 4 and conducted through a passage 24 and a change-over valve 21, which, in the shown embodiment, is a composite of two change-over valves 22 and 23, or atmospheric pressure taken in through an air filter 25 and through the change-over valve 21.

The change-over valve 21 is changed over by a controller 27 which operates in accordance with the output of an oxygen detector 26 which detects residual oxygen contained in the exhaust gases flowing through the exhaust system of the engine.

The air control valve 10 has a first valve seat 29 which defines a first passage 28 between the inlet port 11 and the outlet port 12, a second valve seat 31 which defines a second passage 30 between the inlet port 11 and the relief port 16, and a valve element 32 which reciprocally controls the openings of the first and the second passages 28 and 30 in cooperation with the first and the second valve seats 29 and 31. The valve element 32 is connected with a diaphragm 34 of the diaphragm means 18 by way of a valve stem 33. Above the diaphragm 34 as seen in the figure is defined a first diaphragm chamber 35 communicating to the port 19, while below the diaphragm is defined a second diaphragm chamber 36 communicating to the port 20.

In the diaphragm chamber 35 is provided a compression coil spring 37 which has one end contacting the diaphragm 34 and the other end supported by a seat element 38 which in turn is supported by an adjusting screw 39 whereby the diaphragm 34 is driven downward in the figure by the spring force of the compression coil spring 37. This spring force may be adjusted by loosening a lock nut 40 and turning the screw element 39.

The air control valve 10 further comprises another diaphragm means 41 which has a diaphragm 42 and a third diaphragm chamber 43 defined by the diaphragm 42. The diaphragm 42 is connected with the valve element 32 by way of a valve stem 44. The valve stem 44 has a central bore 45 which opens to the diaphragm chamber 43 at one end thereof and to the outlet port 12 at the other end thereof. In the diaphragm chamber 43 is provided a compression coil spring 46 which engages the diaphragm 42 at one end thereof to exert a force on the diaphragm upwards as seen in the figure. The diaphragms 34 and 42 are firmly connected with each other by way of the valve element 32 and the valve stems 33 and 44 extended at opposite sides of the valve stem. Therefore these diaphragms and the valve element connected therewith are exerted with opposing spring forces by the compression coil springs 37 and 46 so that the valve element is positioned at a neutral position located between and spaced from both the first and second valve seats 39 and 31 due to the balance of the spring forces applied by the compression coil springs 37 and 46. In this case, the air control valve is so adapted that when the diaphragm chambers 35 and 36 are supplied with the same fluid pressure with the engine operating at a predetermined output level, the valve element 32 is positioned as raised up from the valve seat 29 by distance A so that a part of the air supplied to the inlet port 11 from the air pump 9 is conducted through the first passage 28, the outlet port 12, the passage 13, the secondary air manifold 14 and the secondary air supply port 15 to be supplied to the exhaust system of the engine, whereas the rest of the air is conducted through the second passage 30 and the relief port 16 to be relieved, while the air/fuel ratio of exhaust gases is controlled at the stoichiometric value. In this operating condition, the diaphragm chamber 43 is supplied with the pressure of secondary air existing in the outlet port 12 through the central bore 45, whereby the diaphragm 42 is driven upward in the figure by the pressure of secondary air.

The operation of the secondary air supply system shown in FIG. 1 will be explained with reference to FIG. 2. It is now assumed that the engine is operating at a relatively low output level and the flow of secondary air required to adjust the air/fuel ratio of exhaust gases to be in a predetermined window region located close to the stoichiometric air/fuel ratio necessary for effective operation of the three-way catalyst must be in an air flow window region such as W1 shown in FIG. 2. It is also assumed that the change-over valves 22 and 23 of the composite change-over valve 21 are changed over by the controller 27 in a manner such that the diaphragm chamber 35 is supplied with atmospheric pressure, whereas the diaphragm chamber 36 is supplied with manifold vacuum, so that the valve element 32 is shifted downward from the neutral position as shown in FIG. 1. In such a condition, the supply of secondary air is suppressed, and, therefore, the air/fuel ratio of exhaust gases is made smaller, i.e. richer, so that the residual oxygen contained in the exhaust gases flowing through the exhaust system disappears. If the residual oxygen disappears, this is monitored by the oxygen detector 26 and the controller 27 is operated so as to change over the change-over valves 22 and 23 in the opposite direction. By this change-over of the change-over valves, the diaphragm chamber 36 is now open to the atmosphere through the port 20, the change-over valve 23 and the air filter 25, whereas the diaphragm chamber 35 is now connected with the intake manifold 4 through the port 19, the change-over valve 22, and the passage 24. On this occasion, the diaphragm chamber 35 is immediately supplied with intake manifold vacuum just after the changing over of the change-over valve 22, whereas the release of the diaphragm chamber 36 to the atmosphere is somewhat delayed by the throttling action of a throttling element 47 provided at a middle portion of the passage extending from the change-over valve 23 to the air filter 25. Therefore, immediately after the changing-over of the change-over valves 22 and 23, for a moment, the diaphragm chambers 35 and 36 are both supplied with manifold vacuum at substantially the same pressure. At this moment the valve element 32 and the diaphragms 34 and 42 connected therewith is rapidly shifted upward in the figure by the spring force of the compression coil spring 46 and is brought to the neutral position as shown in FIG. 1. By this operation of the air control valve the flow of secondary air changes as shown by the path a in FIG. 2 so that the flow of secondary air rapidly increases up to the central portion of the air flow window region W1 or to the valve which accomplishes the stoichiometric air/fuel ratio of exhaust gases. Thereafter, as the atmospheric air gradually flows into the diaphragm chamber 36 through the throttling element 47, the diaphragm 34, together with the valve element 32 and the diaphragm 42 connected therewith, gradually shifts further upward in the figure. In this case, since in the initial stage of this further shifting the air in the diaphragm chamber 36 is somewhat below atmospheric pressure due to expansion caused by the balancing force of the coil springs 37 and 46, the diaphragm 34 does not make any substantial upward shifting until a certain amount of atmospheric air has been introduced into the diaphragm chamber 36, and, thereafter, the diaphragm 34, together with the valve element 32, substantially shifts upward in the figure as the atmospheric air flows into the diaphragm chamber 36. By this operation, the flow of secondary air changes in accordance with path b shown in FIG. 2. Thus, the flow of secondary air gradually increases, and finally it increases beyond the value which provides the stoichiometric air/fuel ratio of exhaust gases. This is monitored by the oxygen detector 26 which now detects residual oxygen in the exhaust gases flowing through the exhaust system, and the controller 26 is operated so as to change over the change-over valves 22 and 23 in the opposite direction. By this changing over of the change-over valves, the diaphragm chamber 36 is connected with the intake manifold 4 through a change-over valve 23 and the passage 24, and is rapidly supplied with manifold vacuum. On the other hand, the diaphragm chamber 35 is released to the atmosphere through the change-over valve 22 and the air filter 25. However, due to the provision of a throttling element 48 provided at a middle portion of the passage extending from the change-over valve 22 to the air filter 25, the release of the diaphragm chamber 35 to the atmosphere is somewhat delayed. Therefore, immediately after the changing over of the change-over valves, for a moment, the diaphragm chambers 35 and 36 are both supplied with manifold vacuum of substantially the same pressure. At this moment the diaphragm 34 is rapidly driven downward in the figure by the spring force of the compression coil spring 37, so that the valve element 32 is rapidly brought to substantially the neutral position as shown in FIG. 1. The rapid reduction of the flow of secondary air due to such an operation of the air control valve is shown by path c in FIG. 2. Thereafter, as the atmospheric air gradually flows into the diaphragm chamber 35 through the throttling element 48, the diaphragm 34, together with the valve element 32 connected with it, further shifts gradually downward in the figure. In this case also, since in the initial stage the air in the diaphragm chamber 35 is somewhat below atmospheric pressure due to the same effect of the balancing springs as mentioned before, the diaphragm 34 does not make any substantial downward movement until a certain amount of air has been supplied into the diaphragm chamber 35 through the throttling element 48. Thereafter, as air further flows in to the diaphragm chamber 35, the diaphragm 34, together with the valve element 32, further moves gradually downward. The progress of reduction of the flow of secondary air obtained by such an operation of the air control valve is shown by path d in FIG. 2. By the repetition of paths a, b, c, and d the flow of secondary air changes in accordance with a stepped triangular pulse wave such as $\alpha$ in FIG. 2.

Now let us assume that the engine output has been increased. In accordance with this, the range of air flow necessary to maintain the air/fuel ratio of exhaust gases within the window region centered at the stoichiometric air/fuel ratio required for effective operation of the three-way catalyst is changed to an air flow window region such as W2 shown in FIG. 2. In this case, in accordance with the increase of engine output power, the flow of engine intake air and that of exhaust gases also increase, thereby increasing the pressure of the exhaust gases flowing through the exhaust system of the engine. Due to this increase of exhaust gas pressure, the air pressure existing in the outlet port 12 of the air control valve also increases correspondingly. Due to this increase of the air pressure existing in the outlet port 12, the pressure in the diaphragm chamber 43 also increases correspondingly, whereby the force which drives the diaphragm 42 upwards in the figure increases so that the neutral position of the valve element 32 is shifted upward in the figure. Due to this upward shifting of the neutral position of the valve element, the flow of secondary air is correspondingly increased. Due to this modifying function performed by the diaphragm means 41 in response to an increase of engine output or exhaust gas flow, the center line of the stepped triangular pulse wave of the flow of secondary air rapidly shifts from that of the window region W1 to that of the window region W2 in response to a rapid increase of engine output and the stepped triangular pulse wave-shaped variation of the flow of secondary air including paths a–d is repeated in accordance with the requirement for the flow of secondary air. Thus, by employing the secondary air supply system of the present invention, even when engine output rapidly changes, the supply of secondary air closely and stably follows the change of exhaust gas flow so as to maintain the air/fuel ratio of exhaust gases constantly in a predetermined window region. Instead of the throttling elements 47 and 48 provided at a middle portion of the air releasing passages, throttling elements 47*a* and 47*b* may be provided at a middle portion of the vacuum passages, whereby the same paths a and d are obtained. In this case, however, the pressures in the diaphragm chambers 35 and 36 balance with each other at atmospheric pressure in both paths a and d.

Figure 2:
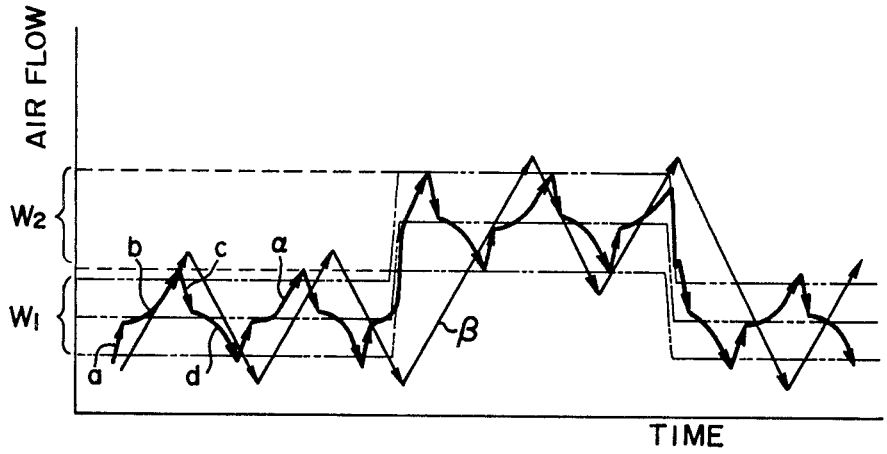
FIG. 2 is a graph showing the secondary air flow performance obtained by the secondary air supply system of the present invention, wherein the secondary air flow performance of a secondary air supply system employing the conventional ON/OFF type air control valve is also shown for the purpose of comparison.

In FIG. 2, for the purpose of comparison, the transient response performance of a conventional secondary air supply system incorporating the aforementioned ON/OFF type air control valve is also shown. In such a conventional secondary air supply system employing an ON/OFF control valve, the change of the air flow window region for the secondary air due to an increase of engine output is followed by the actual change of the flow of secondary air only through the feedback control which necessarily goes through a surplus or shortage in the flow of secondary air due to the change of the flow of exhaust gases. Therefore, in the transient region in the change of the flow of secondary air due to a change of engine output, the triangular pulse wave of the air flow such as in FIG. 2 suffers a great delay, thereby causing very unstable control of secondary air supply.

Figure 3:
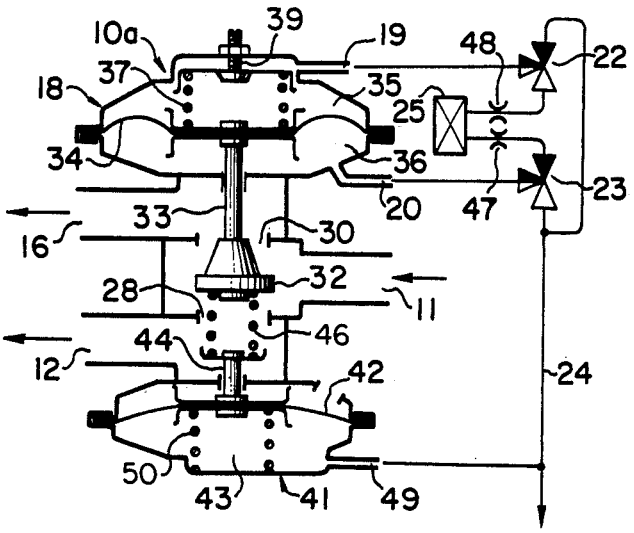
FIGS. 3–5 are diagrammatical views showing other embodiments of the air control valve incorporated in the secondary air supply system shown in FIG. 1, wherein the air control valves are shown together with associated change-over valves for changing over the supply of actuating fluid pressure.

FIG. 3 is a diagrammatical sectional view of another embodiment of the air control valve such as 10 in FIG. 1, shown in combination with the associated actuating fluid pressure change-over valves. In FIG. 3 the portions corresponding to those shown in FIG. 1 are designated by the same reference numerals. In this air control valve 10*a*, the diaphragm chamber 43 is so adapted as to be supplied with intake manifold vacuum through a port 49. When the engine is operating at high output with a high rate of exhaust gas flow, the intake manifold vacuum of the engine is low, whereas when the engine is operating at low output with a low flow rate of exhaust gases, the intake manifold vacuum of the engine is high. Therefore, it will be understood that the relation between the flow rate of exhaust gases and the biasing force exerted on the valve element 32 by the diaphragm 34 is similar to that in the embodiment shown in FIG. 1. In this embodiment, the compression coil spring 46 is interposed between the valve element 32 and the valve stem 44, while the magnitude of intake manifold vacuum is once converted into displacement of the diaphragm 42 under the biasing force exerted on the diaphragm 42 by a spring 50 and the displacement is converted into the biasing force exerted on the valve element 32 by the spring 46.

Figure 4:
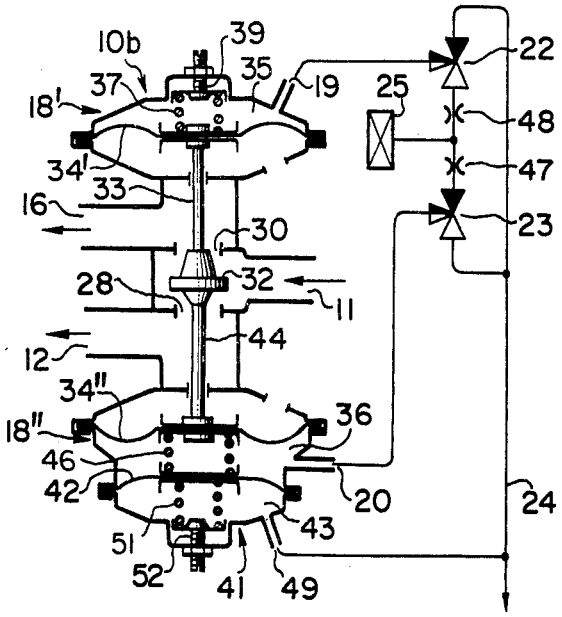

FIG. 4 is a diagrammatical sectional view showing still another embodiment of the air control valve such as 10 in the system shown in FIG. 1, the air control valve being shown in combination with the actuating fluid pressure change-over valves. In FIG. 4 the portions corresponding to those shown in FIGS. 1 and 3 are designated by the same reference numerals, while the portions which correspond to those shown in FIGS. 1 and 3 but are separated into two parts are designated by the same numerals which are individually modified by ′ and ″. In this air control valve 10*b*, the diaphragm means 18 in the former embodiment is replaced by a first diaphragm means 18′ having the diaphragm chamber 35 defined by a diaphragm 34′ and a second diaphragm means 18″ having the diaphragm chamber 36 defined by a diaphragm 34″. The diaphragm 34″ is driven upward in the figure by a series combination of the compression coil spring 46 and another compression coil spring 51 interposed between the diaphragm 42 and an adjusting screw 52 similar to the adjusting screw 39. Also, in this embodiment, the diaphragm chamber 43 is supplied with intake manifold vacuum through the port 49, whereby the neutral position of the valve element 32 is shifted in the same manner as in the embodiment shown in FIG. 3 in accordance with changes of engine output or exhaust gas flow of the engine.

Figure 5:
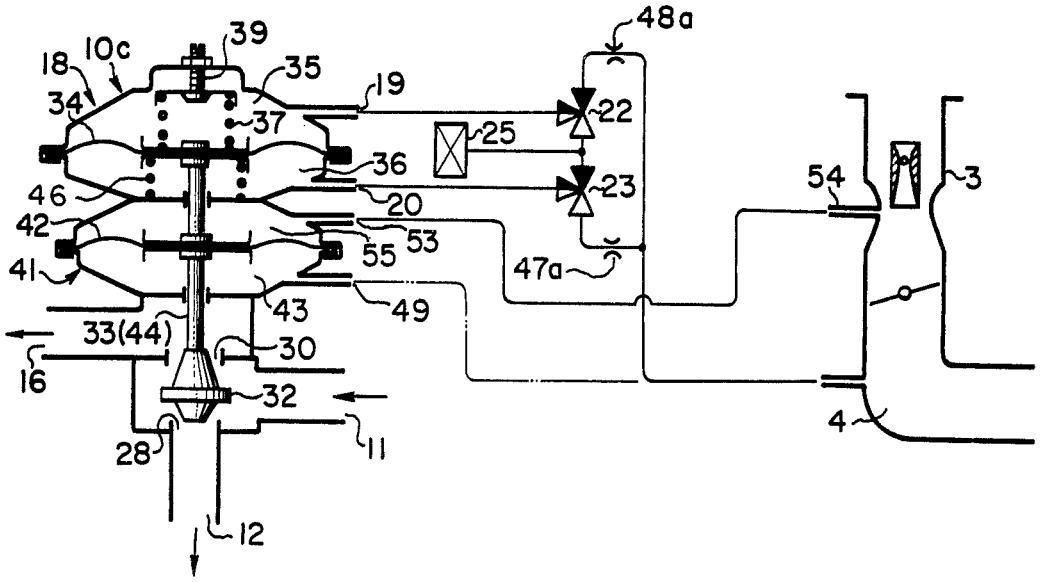

FIG. 5 is a diagrammatical sectional view of still another embodiment of the air control valve such as 10 shown in FIG. 1, wherein the air control valve 10*c* is shown in combination with the associated actuating fluid pressure change-over valves and the source of actuating fluid pressure. In FIG. 5, the portions corresponding to those shown in FIGS. 1–4 are designated by the same reference numerals. However, it is to be noted that FIG. 5 also shows a modification of the air control valve 10*c*. In the basic structure of the embodiment shown in FIG. 5, the diaphragm means 41 for modifying the neutral position of the valve element 32 in accordance with changes of output or exhaust gas flow of the engine has the diaphragm chamber 43 supplied with manifold vacuum through the port 49, while on the other hand, as a modification, the diaphragm means 41 for modifying the neutral position of the valve element 32 in accordance with changes of output or exhaust gas flow of the engine may have a diaphragm chamber 55 supplied with venturi vacuum taken out from a venturi vacuum port 54 provided in the carburetor 3 through a port 53. It is enough if only one of these two modifications of the neutral position of the valve element 32 by the diaphragm chambers 43 and 55 is performed. The manner of modifying the neutral position of the valve element 32 in accordance with changes of output or exhaust gas flow of the engine by introduction of intake manifold vacuum to the diaphragm chamber 43 is the same as in the embodiments shown in FIGS. 3 and 4. With regard to the modification of the neutral position of the valve element 32 in response to changes of output or exhaust gas flow of the engine by the introduction of venturi vacuum to the diaphragm chamber 54, it will be understood that if engine output power increases with the flow of intake air being correspondingly increased, the venturi vacuum correspondingly increases, whereby the diaphragm 42 is driven upward in the figure so as to exert a correspondingly increased upward biasing force to the valve element 32, so that when engine output power increases, the opening of the first passage 28 communicating to the output port 12 is increased so as to increase the flow of secondary air as a whole.

Although in the above explanations intake manifold vacuum is used as the actuating fluid pressure to be supplied to the diaphragm chambers 35 and 36 in an exchanging manner with atmospheric pressure by the changing over operation of the change-over valve 21, the delivery air pressure of the air pump 9 conducted through a passage 56 may be used instead of intake manifold vacuum. This modification with regard to the actuating fluid pressure is also applicable to the embodiments shown in FIGS. 3–5.

Although the invention has been shown and described with respect to some preferred embodiments thereof, it should be understood by those skilled in the art that various changes and omissions of the form and detail thereof may be made therein without departing from the scope of the invention.

I claim:

1. A secondary air supply system for the exhaust system of an internal combustion engine, comprising a source of compressed air, an air control valve which supplies a part of the air delivered from said source to the exhaust system of the engine while relieving the rest of the air, an oxygen detector for detecting residual oxygen contained in the exhaust gases flowing through the exhaust system, a source of actuating fluid pressure, a change-over valve for said actuating fluid pressure, and a controller which changes over said change-over valve in accordance with the output of said oxygen detector, said air control valve having an inlet port for receiving air from said source of compressed air, an outlet port for supplying a part of the air received to the exhaust system, a relief port for relieving the rest of the air received, a first passage which connects said inlet port and said outlet port, a second passage which connects said inlet port and said relief port, a valve element which reciprocally controls the openings of said first and second passages, first and second springs which reciprocally operate to balance said valve element at a position where a predetermined opening ratio of said first passage to said second passage is established, first and second diaphragm chambers selectively supplied with either said actuating fluid pressure or atmospheric pressure by way of said change-over valve, a third diaphragm chamber supplied with a fluid pressure which represents exhaust gas flow of the engine, and diaphragms which define said individual diaphragm chambers and are connected with said valve element, wherein said diaphragms are adapted so as to shift said valve element against the balancing force of said first and second springs in the direction to increase the opening of said first passage and to decrease the opening of said second passage when the fluid pressure in said first diaphragm chamber is lower than the fluid pressure in said second diaphragm chamber, so as to shift said valve element against the balancing force of said first and second springs in the direction to increase the opening of said second passage and to decrease the opening of said first passage when the fluid pressure in said second diaphragm chamber is lower than the fluid pressure in said first diaphragm chamber, and so as to shift said valve element by varying the balance point of said first and second springs in the direction to increase the opening of said first passage and to decrease the opening of said second passage when the fluid pressure in said third diaphragm chamber changes so as to indicate increase of secondary air demand or exhaust gas flow of the engine.

2. The secondary air supply system of claim 1, wherein said air control valve has first and second diaphragm means, said first diaphragm means including a first one of said diaphragms, said first and second diaphragm chambers defined at opposite sides of said one diaphragm, a first valve stem connecting said first diaphragm and said valve element, and said first spring acting on said one diaphragm, said second diaphragm means including a second one of said diaphragms, said third diaphragm chamber defined at one side of said other diaphragm, a second valve stem connecting said second diaphragm and said valve element, and said second spring acting on said other diaphragm, said second stem having a central bore having one end opened to said third diaphragm chamber and the other end opened to said outlet port.

3. The secondary air supply system of claim 2, wherein said first and second springs are both compression coil springs and are located at the remote sides of said first and second diaphragms respectively as viewed from the valve element.

4. The secondary air supply system of claim 1, wherein said air control valve comprises first and second diaphragm means, said first diaphragm means including a first one of said diaphragms, said first and second diaphragm chambers defined at opposite sides of said first diaphragm, a valve stem connecting said first diaphragm and said valve element, and said first spring acting on said first diaphragm, said second diaphragm means including a second one of said diaphragms, said third diaphragm chamber defined at one side of said second diaphragm, and said second spring acting on said second diaphragm, further including a third spring interposed substantially between said second diaphragm and said valve element.

5. The secondary air supply system of claim 4, wherein said first and second springs are both compression coil springs located at the remote sides of said first and second diaphragms respectively as viewed from said valve element, said third spring being also a compression coil spring.

6. The secondary air supply system of claim 1, wherein said air control valve comprises first and second diaphragm means, said first diaphragm means including a first one of said diaphragms, said first diaphragm chamber defined at one side of said first diaphragm, a first valve stem connecting said first diaphragm and said valve element, and said first spring acting on said first diaphragm, said second diaphragm means including second and third ones of said diaphragms, said second diaphragm chamber defined between said second and third diaphragms, said third diaphragm chamber defined at one side of said third diaphragm, a second valve stem connecting said second diaphragm and said valve element, said second spring acting on said third diaphragm, and a third spring acting between said second and third diaphragms.

7. The secondary air supply system of claim 6, wherein said first and second springs are both compression coil springs and located at the remote sides of said first and third diaphragms respectively as viewed from said valve element, while said third spring is also a compression coil spring disposed between said second and third diaphragms.

8. The secondary air supply system of claim 1, wherein said air control valve comprises first and second diaphragm means, said first diaphragm means including a first one of said diaphragms, said first and second diaphragm chambers defined at opposite sides of said one diaphragm, a valve stem connecting said first diaphragm and said valve element, and said first and second springs acting on opposite sides of said first diaphragm, said second diaphragm means including a second one of said diaphragms, said third diaphragm chamber defined at one side of said second diaphragm, and said valve stem at a middle portion of which said second diaphragm is connected.

9. The secondary air supply system of claim 8, wherein said third diaphragm chamber is located at the remote side of said second diaphragm as viewed from said first diaphragm means, said third diaphragm chamber being adapted to be supplied with intake manifold vacuum of the engine.

10. The secondary air supply system of claim 8, wherein said third diaphragm chamber is located at the close side of said second diaphragm as viewed from said first diaphragm means, said third diaphragm chamber being adapted to be supplied with intake venturi vacuum of the engine.

* * * * *